US008456261B2

(12) United States Patent
Inagaki

(10) Patent No.: US 8,456,261 B2
(45) Date of Patent: Jun. 4, 2013

(54) ELECTROMAGNETIC SWITCH

(75) Inventor: Takahisa Inagaki, Nishio (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/529,279

(22) Filed: Jun. 21, 2012

(65) Prior Publication Data

US 2013/0049906 A1 Feb. 28, 2013

(30) Foreign Application Priority Data

Aug. 30, 2011 (JP) ..... 2011-187724

(51) Int. Cl.
*H01H 67/02* (2006.01)

(52) U.S. Cl.
USPC ..... 335/132; 335/46; 335/202

(58) Field of Classification Search
USPC ..... 335/46, 104, 132, 193, 202
See application file for complete search history.

(56) References Cited

U.S. PATENT DOCUMENTS 3,568,114 A * 3/1971 Cherry et al. ..... 335/202
3,821,671 A * 6/1974 Grunert et al. ..... 35/132
5,495,220 A * 2/1996 Takaya et al. ..... 335/274
6,297,717 B1 * 10/2001 Heckenkamp ..... 335/132
8,217,740 B2 * 7/2012 Nakagawa ..... 335/132
2009/0096559 A1 * 4/2009 Yano et al. ..... 335/187
2012/0206220 A1 * 8/2012 Niimi et al. ..... 335/71

FOREIGN PATENT DOCUMENTS

EP 355606 A2 * 2/1990
JP 58115731 A * 7/1983
JP 10334784 A * 12/1998
JP 2002208338 A * 7/2002
JP A-2003-297207 10/2003
JP 2004311293 A * 11/2004

* cited by examiner

*Primary Examiner* — Mohamad Musleh
(74) *Attorney, Agent, or Firm* — Oliff & Berridge, PLC

(57) ABSTRACT

The electromagnetic switch includes an excitation coil serving as an electromagnet when energized, a fixed core magnetized by the electromagnet, a movable core configured to move by being attracted by the fixed core being magnetized, a pair of fixed contacts interposed in an electrical circuit, and a movable contact configured to move in accordance with movement of the movable core to make and break electrical connection between the fixed contacts. The electromagnetic switch further includes a stopper for restraining movement of the movable core for preventing short-circuit between the fixed contacts through the movable core due to abrasion of members of the electromagnetic switch.

4 Claims, 3 Drawing Sheets

ELECTROMAGNETIC SWITCH

This application claims priority to Japanese Patent Application No. 2011-187724 filed on Aug. 30, 2011, the entire contents of which are hereby incorporated by reference.

BACKGROUND OF THE INVENTION

1. Field of the Invention

The present disclosure relates to an electromagnetic switch for interrupting a current flowing through an electrical circuit by opening and closing an electrical contact.

2. Description of Related Art

Japanese Patent Application Laid-open No. 2003-297207 discloses an electromagnetic switch as shown in FIGS. 3A to 3C. This electromagnetic switch 100 includes an excitation coil 101, a movable core 102 driven by magnetic force generated by the excitation coil 101, and an electrical contact opened and closed in accordance with movement of the movable core 102. The electrical contact is constituted of a pair of fixed contacts 103 and a movable contact 104 movable in accordance with movement of the movable core 102.

The movable contact 104 is provided movably to be in contact and out of contact with the end portions on one axial end side of the fixed contacts 103. A shaft 107 is fixed to the movable core 102 so as to be abuttable against the end surface on the other axial end side of the movable contact 104. The fixed contacts 103 are held within a resin-made housing 108 accommodating a contact pressure spring 110 for biasing the movable contact 104 toward the other axial end side (toward the fixed contacts 103).

While the excitation coil 101 is deenergized, since the movable core 102 is biased toward the one axial end side by a return spring 111 causing the shaft 107 to push the movable contact 104 toward the one axial end side, the movable contact 104 is in the opened state in which the movable contact 104 is away from the fixed contacts 103. Movement of the movable contact 104 toward the one axial end side is restrained when the movable contact 104 abuts against a contact abutment portion 108*a* provided in the housing 108. When the excitation coil 101 is energized in this state, the movable core 102 is attracted toward the other axial end side against the biasing force of the return spring 111, causing the shaft 107 to move away from the movable contact 104. As a result, since the force pressing the movable contact 104 toward the one axial side is removed, the movable contact 104 is biased toward the fixed contacts 103 by the contact pressure spring 110 to be in the closed state in which it is in contact with the fixed contacts 103. The above described electromagnetic switch 100 is configured such that there is a clearance c between the movable core 102 and the fixed contacts 103 so that they do not contact with each other in the open state. However, abrasion may occur in the surface of the movable contact 104, the surface of the shaft 107 abutting against the movable contact 104, or the surface of the contact abutment portion 108*a* abutting against the movable contact 104 due to a larger number of times of operations or vibration of the electromagnetic switch 100. Such abrasion causes the clearance c to become smaller, as a result of which the fixed contacts 103 may be short-circuited with each other through the movable core 102 when the electromagnetic switch 100 in in the open state. To avoid this problem, it might occur that the clearance c is set larger in the initial state where there is no such abrasion. However, to do so, since it is necessary to increase the dimension of the electromagnetic switch 100 in the axial direction, the electromagnetic switch 100 has to be upsized.

SUMMARY

An exemplary embodiment provides an electromagnetic switch including:

an excitation coil serving as an electromagnet when energized;

a fixed core magnetized by the electromagnet;

a movable core configured to move by being attracted by the fixed core being magnetized;

a pair of fixed contacts interposed in an electrical circuit;

a movable contact configured to move in accordance with movement of the movable core to make and break electrical connection between the fixed contacts; and a shaft fixed to the movable core for transmitting movement of the movable core to the movable contact by abutting against the movable contact, the movable contact being disposed so as to move to and away from one ends of the fixed contacts on one axial end side of the electromagnetic switch, the movable core being disposed such that one end surface thereof in an axial direction of the electromagnetic switch is opposed to the other ends of the fixed contacts on the other axial end side of the electromagnetic switch, the shaft being disposed so as to extend from the movable core toward the other axial end side, movement of the movable core being transmitted to the movable contact when an end surface of the shaft on the other axial end side abuts against the movable contact, wherein, when, of end surfaces of the fixed contacts and members of the electromagnetic switch electrically connected to the fixed contacts, the one opposing to the movable core and located closest to the other axial end side of the electromagnetic switch is referred to as a contact other end surface, the electromagnetic switch further includes a stopper member for restraining movement of the movable core toward the one axial end side for preventing abutment between the one end surface of the movable core and the contact other end surface.

According to the exemplary embodiment, there is provided an electromagnetic switch capable of preventing occurrence of short-circuit between fixed contacts through a movable core due to abrasion of components of the electromagnetic switch without increasing the axial dimension of the electromagnetic switch.

Other advantages and features of the invention will become apparent from the following description including the drawings and claims.

PREFERRED EMBODIMENTS OF THE INVENTION

First Embodiment

Figure 1B:
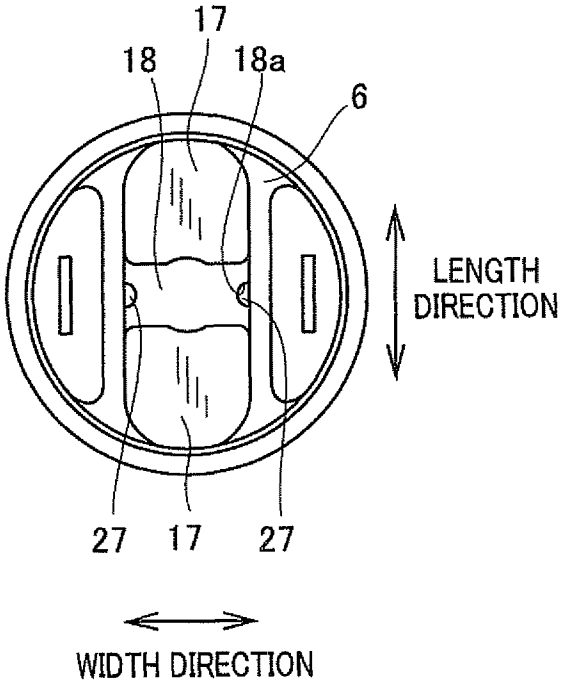
FIG. 1B is an elevational view of a resin housing of the electromagnetic switch according to the first embodiment as viewed from the axial end side.
Figure 1A:
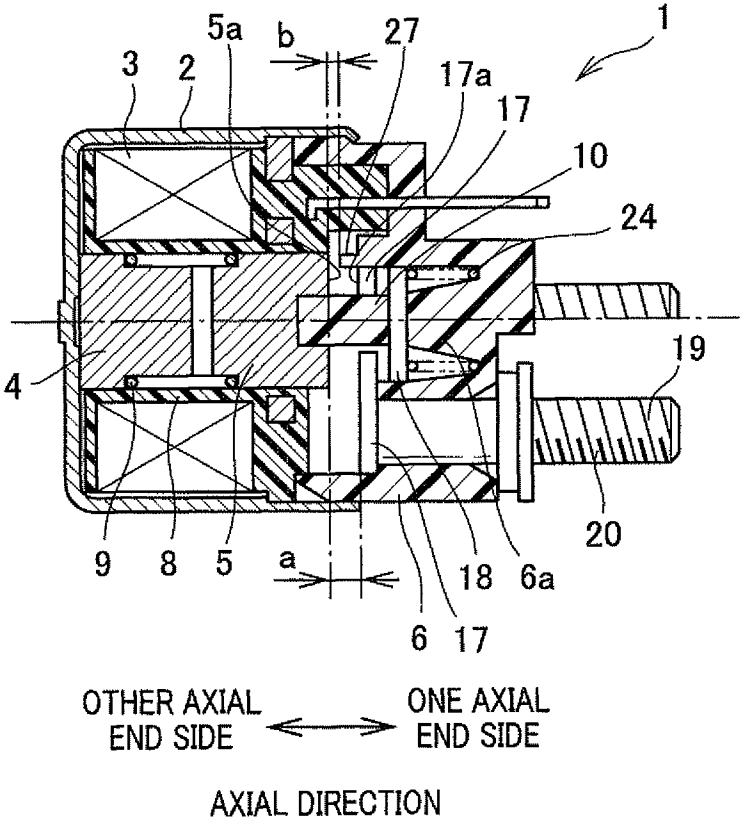
FIG. 1A is a cross-sectional view of an electromagnetic switch according to a first embodiment of the invention.

An electromagnetic switch 1 shown in FIGS. 1A and 1B according to a first embodiment of the invention is used for interrupting a coil current supplied to a starter for starting a vehicle engine, for example. The electromagnetic switch 1 includes a switch case 1, an excitation coil 3, a fixed core 4, a movable core 5, an electrical contact and a resin housing 6.

The switch case 2, which has a shape of a bottomed cylinder opening at one axial end thereof, forms a part of a magnetic circuit for passing magnetic flux generated when the excitation coil 3 is energized.

When a coil energization switch (not shown) is operated, the excitation coil 3 is energized to serve as an electromagnet by a current supplied from a vehicle battery. The excitation coil 3 is wound around a bobbin 8 within the switch case 2.

The fixed core 4 which is made of a ferromagnetic material (iron, for example) is shaped into a column. The fixed core 4 is disposed inside the excitation coil 3 on the side of the bottom of the switch case 2, and forms the magnetic circuit together with the switch case 2.

The movable core 5 which is made of a ferromagnetic material (iron, for example) is shaped into a column. One axial end surface of the movable core 5 is shaped into a circle. The movable core 5 is disposed inside the excitation coil 3 so as to be opposed to the fixed core 4 and movable in the axial direction. Accordingly, when the excitation coil 3 is energized to magnetize the fixed core 4, the movable core 5 is attracted by the fixed core 4 and moves toward the side of the fixed core 4 (toward the other axial end side). The movable core 5 is biased toward the opposite fixed core side (55 toward the one axial end side) by a return spring 9 disposed between the movable core 5 and the fixed core 4. A shaft 10 is disposed on the side of one axial end of the movable core 5.

The shaft 10, which is made of resin, is fixed to the movable core 5 by being pressure-inserted or swaged into a hole formed in one axial end surface of the movable core 5. The shaft 10 projects toward the resin housing 6 at one axial end thereof.

The resin housing 6, which is a resin mold product, is swaged to one axial end of the switch case 2 with the fixed core 4 being held between the bobbin 8 and the resin housing 6. The resin housing 6 serves as a cover closing the opening of the switch case 2.

The electrical contact is constituted of a pair of fixed contacts 17 and a movable contact 18 for interrupting a current flowing between the fixed contacts 17. The fixed contacts 17 are disposed opposite to each other with a clearance therebetween in the direction perpendicular to the axial direction. They are provided integrally with, or fixed to terminal bolts 19 and 20, respectively. The fixed contacts 17 and the terminal bolts 19 and 20 are held by the resin housing 6.

One of the terminal bolts 19 and 20 is connected to the side of the battery, and the other is connected to the side of a device such as a motor. When the direction in which the fixed contacts 17 are opposed to each other is referred to as the length direction, and the direction perpendicular to the length direction and the axial direction is referred to as the width direction, the dimension of the fixed contacts 17 in the width direction is nearly the same as or larger than the diameter of the movable core 5.

The movable contact 18 is disposed on the side of the one axial end of the fixed contacts 17 so as to be able to move to and away from the one axial end surfaces of the fixed contacts 17. The movable contact 18 is applied with load from a contact pressure spring 24, and abuts against the end surface of the shaft 10 fixed to the movable core 5 while the electrical contact is open. The movable contact 18 and the contact pressure spring 24 are accommodated in a space formed on the one axial end side of the fixed contact 17 within the resin housing 6. The resin housing 6 is formed with a contact abutment portion 6*a* having a truncated cone shape for restraining movement of the movable contact 18 toward the axial end side. A space for accommodating the contact pressure spring 24 is provided around the outer circumference of the contact abutment portion 6*a*.

Since the set load of the contact pressure spring 24 is smaller than that of the return spring 9, the movable core 5 is in the state of being pushed back toward the one axial end side (toward the opposite fixed core side) by the biasing force of the return spring 9 while the excitation coil 3 is deenergized. Accordingly, as shown in FIG. 1A, the movable contact 18 is pushed in the direction to move away from the fixed contacts 17 through the shaft 10 fixed to the movable core 5, and pressed against the contact abutment portion 6*a* of the resin housing 6 in the state of the contact pressure spring 24 being compressed.

When the excitation coil 3 is energized, and the movable core 5 is attracted toward the other axial end side (toward the fixed core side) in this state, since the pressing force applied to the movable contact 18 by the contact pressure spring 24 is removed, the movable contact 18 is brought to the state of being pressed against the fixed contacts 17 (the closed state).

Next, distinguishing features of the first embodiment described above are explained.

When, of the end surfaces of the fixed contacts 17 and the members electrically connected to the fixed contacts 1, the one opposing to the movable core 5 and located closest to the other axial end side of the electromagnetic switch 1 is referred to as "a contact other end surface 17*a*", the electromagnetic switch 1 includes stopper members 27 for restraining movement of the movable core 5 toward the one axial end side to avoid abutment between the one axial end surface of the movable core 5 and the contact other end surface 17*a*.

In this embodiment, the contact other end surface 17*a* is the other axial end surfaces of the fixed contacts 17. Here, if the terminal bolts 19 and 20 project more than the fixed contacts 17 toward the other axial end side, the contact other end surface 17*a* is the other axial end surfaces of the terminal bolts 19 and 20.

The stopper members 27 are provided integrally with the resin housing 6 so as to be opposed to the one axial end surface 5*a* of the movable core 5. In this embodiment, as shown in FIG. 1B, the stopper members 27 are formed by extending part of the resin section housing 6 holding the fixed contacts 17 toward the other axial end side. In this embodiment, the stopper members 27 are two in number. The two stopper members 27 are disposed so as to hold the width-direction center of the fixed contacts 17 therebetween in the width direction.

More specifically, as shown in FIG. 1B, the part of the resin housing 6 extending along the periphery of the fixed contacts 17 in the length direction projects inwardly from both ends in the width direction at the length-direction center of the fixed contacts 17, and also projects toward the other axial end side so as to form the stopper members 27. The stopper members 27 project slightly into the clearance between the fixed contacts 17. Accordingly, the movable contact 18 is formed with notches 18*a* to prevent interference with the stopper members 27.

The axial-direction clearance b to the movable core 5 is the same for the two stopper members 27. This axial-direction clearance b is smaller than the axial-direction distance a between the contact other end surface 17*a* and the movable core 5 when the electrical contact is open in the initial state where there is no abrasion.

The first embodiment described above provides the following advantages. The electromagnetic switch 1 of this embodiment includes the stopper members 27 for restraining movement of the movable core 5 toward the one axial end side for preventing abutment between the movable core 5 and the contact other end surface 17*a*. The axial-direction clearance b between the stopper members 27 and the movable core 5 is smaller than the axial-direction distance a between the contact other end surface 17*a* and the movable core 5 when the electrical contact is open in the initial state where there is no abrasion. Accordingly, if there is an increase of the distance by which the movable core 5 is pushed back toward the one axial end side by the return spring 9 when the electrical contact is opened, the movable core 5 can be prevented from abutting against the contact other end surface 17*a*, because excessive movement of the movable core 5 toward the one axial end side is restrained by the stopper members 27. Hence, according to the first embodiment, it is possible to prevent short-circuit between the fixed cores 17.

Further, since the electromagnetic switch 1 has the structure capable of restraining movement of the movable core 5 reliably using the stopper members 27, it is not necessary to secure a large clearance between the movable core 5 and the fixed contacts 17, and accordingly it is not necessary to increase the axial-direction dimension of the electromagnetic switch 1.

The stopper members 27 are provided integrally with the resin housing 5. This makes it possible to reduce the cost for providing the electromagnetic switch 1 with the stopper members.

The stopper members 27 are two in number, so that the width-direction center of the fixed contacts 17 is held between the two stopper members 27. The axial-direction clearance b to the movable core 5 is the same for the two stopper members 27. This makes it possible to prevent the movable core 5 from being inclined when the movable core 5 abuts against the stopper members 27 due to component abrasion, to reliably prevent a short-circuit between the fixed contacts 17.

Second Embodiment

Next, a second embodiment is described with a focus on differences with the first embodiment.

In the second embodiment, the diameter of the movable core 5 is larger than the width-direction length of the fixed contacts 17. Accordingly the movable core 5 is separated from both width-direction sides of the fixed cores 17 when viewed from the axial direction (see FIG. 2B). The stopper members 27 are disposed at positions separated from the fixed contacts 17 in the width direction.

Figure 2B:
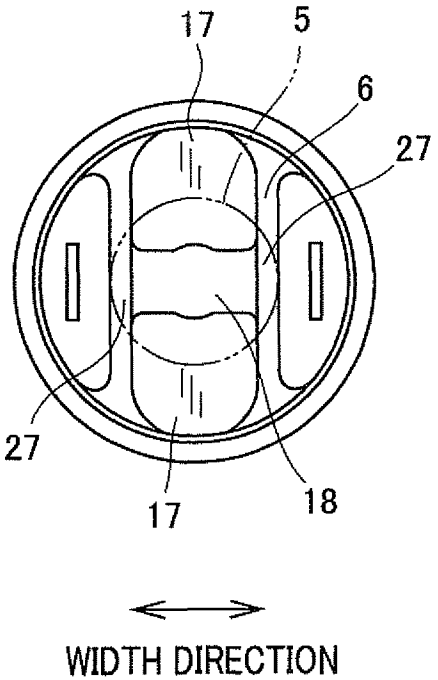
FIG. 2B is an elevational view of a resin housing of the electromagnetic switch according to the second embodiment as viewed from the other axial end side.
Figure 2A:
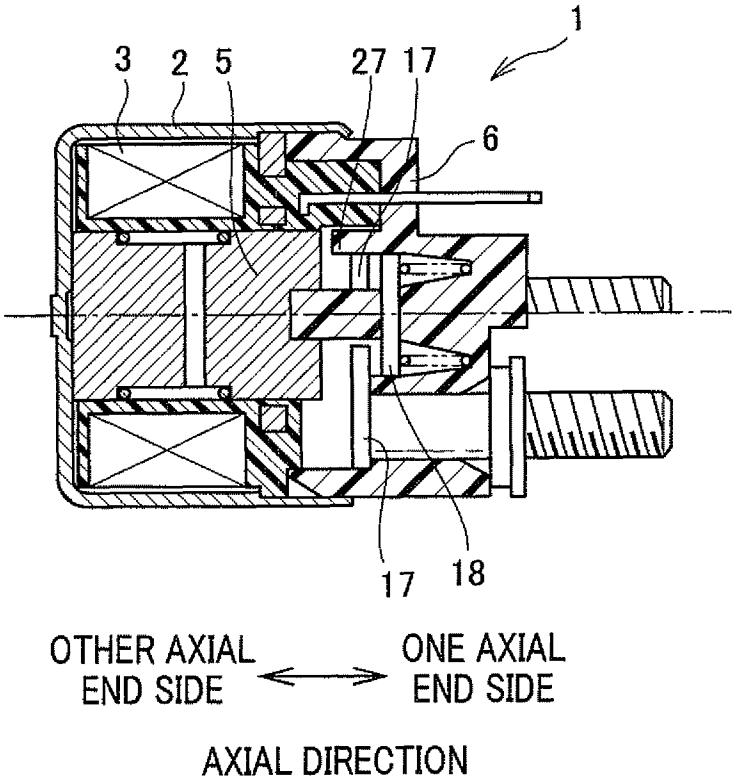
FIG. 2A is a cross-sectional view of an electromagnetic switch according to a second embodiment of the invention.
Figure 3B:
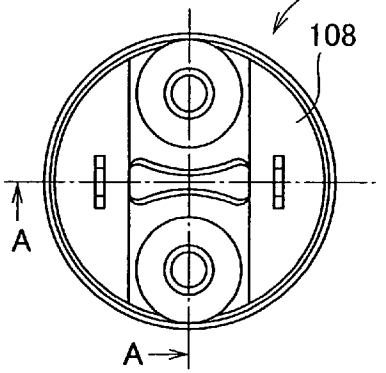
FIG.3B PRIOR ART
FIG. 3B is an elevational view of the conventional electromagnetic switch as viewed from one axial end side.
Figure 3C:
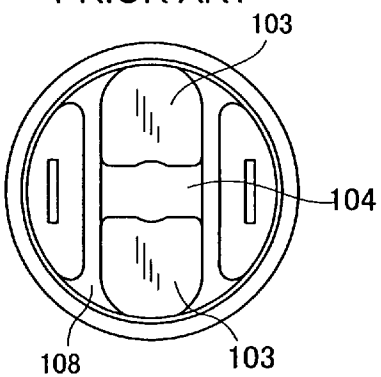
FIG.3C PRIOR ART
FIG. 3C is an elevational view of a resin housing of the conventional electromagnetic switch as viewed from the other axial end side.
Figure 3A:
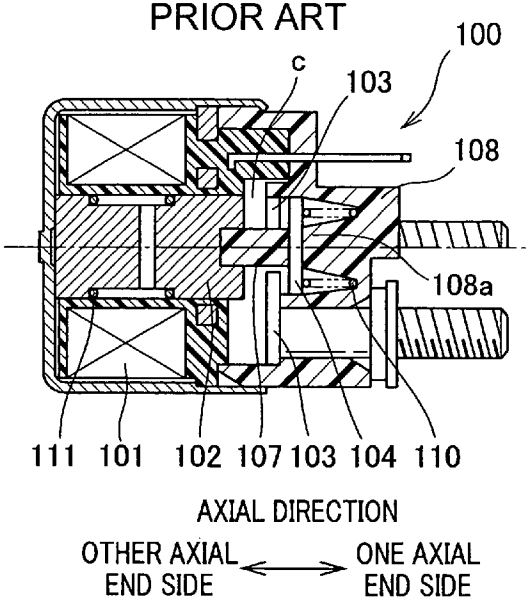
FIG.3A PRIOR ART
FIG. 3A is a cross-sectional view of a conventional electromagnetic switch.

That is, as shown in FIG. 2B, the resin housing 6 is formed with projections as the stopper members 27 which project toward the other axial end side at positions outside of both the width-direction sides of the fixed contacts 17.

This makes it possible to provide the stopper members 27 outside the fixed contacts 17 with respect to the width direction. In the first embodiment in which the stopper members 27 are provided at positions inside of the width-direction sides of the fixed contacts 17, the movable contact 18 has to be formed with the notches 18*a*. According to the second embodiment, it not necessary to form such notches in the movable contact 18.

Modifications

In the first and second embodiments, the stopper members 27 are provided integrally with the resin housing 26. However, the stopper members 27 may be provided as separate members. Further, the stopper members 27 may be projections formed in the one axial end surface of the movable core 5 so as to project toward the resin housing 6. The stopper members 27 may be three or more in number.

The present invention can be used for a starter having an electromagnetic switch of the type including two movable cores and two excitation coils for attracting two movable cores, respectively, as described, for example, in Japanese Patent Application. Laid-open No. 2010-23001. The present invention can be used also for an ICR relay (Inrush Current Reduction relay).

The above explained preferred embodiments are exemplary of the invention of the present application which is described solely by the claims appended below. It should be understood that modifications of the preferred embodiments may be made as would occur to one of skill in the art.

What is claimed is:

1. An electromagnetic switch comprising:

an excitation coil serving as an electromagnet when energized;

a fixed core magnetized by the electromagnet;

a movable core configured to move by being attracted by the fixed core being magnetized;

a pair of fixed contacts interposed in an electrical circuit, each fixed contact having a first end and a second end; members of the electromagnetic switch electrically connected to the fixed contacts;

a movable contact configured to move in accordance with movement of the movable core to make and break electrical connection between the fixed contacts; and a shaft fixed to the movable core for transmitting movement of the movable core to the movable contact by abutting against the movable contact, the movable contact being disposed so as to move to and away from the first ends of the fixed contacts on one axial end side of the electromagnetic switch, the movable core being disposed such that one end surface thereof in an axial direction of the electromagnetic switch is opposed to the second ends of the fixed contacts on the other axial end side of the electromagnetic switch, the shaft being disposed so as to extend from the movable core toward the other axial end side, movement of the movable core being transmitted to the movable contact when an end surface of the shaft on the other axial end side abuts against the movable contact, wherein, when, among end surfaces of the fixed contacts and end surfaces of the members of the electromagnetic switch electrically connected to the fixed contacts, the one opposing to the movable core and located closest to the other axial end side of the electromagnetic switch is referred to as a contact other end surface, the electromagnetic switch further comprises a stopper for restraining movement of the movable core toward the one axial end side for preventing an electrical short circuit between the one end surface of the movable core and the contact other end surface, and when the excitation coil is deenergized, a first axial-direction clearance exists between the stopper and the one axial end surface of the movable core and a second axial-direction clearance exists between the contact other end surface of the fixed contacts and the one axial end surface of the movable core; and wherein the one end surface of the movable core in the axial direction has a circular shape, when a direction perpendicular to the axial direction and a direction in which the fixed contacts are opposed to each other is referred to as a width direction, a diameter of the one end surface of the movable core in the axial direction is larger than a length of the fixed contacts in the width direction, and the stopper is disposed so as to lie off the fixed contacts in the width direction.

2. The electromagnetic switch according to claim 1, further comprising a resin housing holding the fixed contacts, the stopper being integrally formed in the resin housing.

3. The electromagnetic switch according to claim 1, wherein the stopper is constituted of a plurality of stopper members, when a direction perpendicular to the axial direction and a direction in which the fixed contacts are opposed to each other is referred to as a width direction, at least two of the stopper members are disposed opposite to each other across from center of the fixed contacts in the width direction, and distance from the stopper member to the movable core is the same for all of the stopper members.

4. The electromagnetic switch according to claim 1, where the first axial-direction clearance is smaller than the second axial-direction clearance.

* * * * *